US011129427B2

(12) United States Patent
Shigaki

(10) Patent No.: US 11,129,427 B2
(45) Date of Patent: Sep. 28, 2021

(54) HYBRID GLOVE

(71) Applicant: Lee Y. Shigaki, Honolulu, HI (US)

(72) Inventor: Lee Y. Shigaki, Honolulu, HI (US)

( * ) Notice: Subject to any disclaimer, the term of this patent is extended or adjusted under 35 U.S.C. 154(b) by 48 days.

(21) Appl. No.: 16/157,207

(22) Filed: Oct. 11, 2018

(65) Prior Publication Data

US 2019/0110537 A1 Apr. 18, 2019

Related U.S. Application Data

(60) Provisional application No. 62/571,424, filed on Oct. 12, 2017.

(51) Int. Cl.

| | |
|---|---|
| ***A41D 19/00*** | (2006.01) |
| ***A41D 19/01*** | (2006.01) |
| ***A41D 27/24*** | (2006.01) |
| ***A41D 19/015*** | (2006.01) |
| ***A41D 19/02*** | (2006.01) |
| ***A41D 31/00*** | (2019.01) |

(52) U.S. Cl.

CPC ..... *A41D 19/02* (2013.01); *A41D 19/0051* (2013.01); *A41D 19/0082* (2013.01); *A41D 19/01* (2013.01); *A41D 27/24* (2013.01); *A41D 31/00* (2013.01); *A41D 19/0072* (2013.01); *A41D 19/015* (2013.01); *A41D 2400/44* (2013.01); *A41D 2400/52* (2013.01); *A41D 2500/40* (2013.01); *A41D 2500/52* (2013.01)

(58) Field of Classification Search

CPC ..... A41D 9/015; A41D 9/01; A41D 9/0051; A41D 9/082; A41D 2400/52; A41D 19/02; A41D 19/002; A47K 7/02; A47L 13/18

USPC ..... 2/16, 20, 158, 167; 294/25

See application file for complete search history.

(56) References Cited

U.S. PATENT DOCUMENTS

| | | | | |
|---|---|---|---|---|
| 2,751,592 | A | 6/1956 | Longstreth et al. | |
| 2,840,950 | A | 7/1958 | Cotler | |
| 5,020,160 | A * | 6/1991 | Cano | A41D 19/0093 2/158 |
| D381,130 | S * | 7/1997 | Anderson | D29/118 |
| 5,659,899 | A | 8/1997 | Soter et al. | |
| 5,881,388 | A | 3/1999 | Pratt | |

(Continued)

FOREIGN PATENT DOCUMENTS

| | | |
|---|---|---|
| CN | 2562604 Y | 7/2003 |
| CN | 2788592 Y | 6/2006 |

(Continued)

*Primary Examiner* — Katherine M Moran

(74) *Attorney, Agent, or Firm* — Meagher Emanuel Laks Goldberg & Liao, LLP

(57) ABSTRACT

A pair of short length disposable finger food gloves protecting the fingers and thumb from oily foods, juicy sauces, sticky syrups, liquids, and all other food residue while eating finger foods when hand washing is not accessible where the design accommodates the use of this glove by offering various shapes (e.g., with an extended tab) along the diagonal hemline to aid in dressing the hand with circular, square, rectangle, inverted triangle, and triangle forms or tabs to pinch and pull to insert the hand with optional combinations of shapes for the knuckle side and palm side of the hands whereby the material used will be of a lightweight vinyl, polyurethane, paper, felt, fabric, rubber or a combination of materials with various sizes and optional colors to suit the wearer.

16 Claims, 24 Drawing Sheets

(56) References Cited

U.S. PATENT DOCUMENTS

| | | | | |
|---|---|---|---|---|
| 5,987,645 | A | 11/1999 | Teaster | |
| 6,041,438 | A | 3/2000 | Kirkwood | |
| 6,687,911 | B2 * | 2/2004 | Fitz | A41D 19/0075 2/163 |
| D583,104 | S | 12/2008 | Stewart | |
| D694,960 | S * | 12/2013 | Shibahara | D29/117.1 |
| 2005/0223469 | A1 | 10/2005 | Banton | |
| 2008/0172767 | A1 * | 7/2008 | Friedstrom | A47K 7/02 2/16 |
| 2008/0229478 | A1 | 9/2008 | Maroun | |
| 2010/0313332 | A1 | 12/2010 | Denis | |
| 2013/0067635 | A1 * | 3/2013 | Lin | A41D 19/0006 2/161.6 |
| 2014/0289931 | A1 * | 10/2014 | Patkov | A41D 19/001 2/168 |
| 2017/0000199 | A1 * | 1/2017 | Guzman | A41D 13/087 |

FOREIGN PATENT DOCUMENTS

| | | | |
|---|---|---|---|
| CN | 2865344 | Y | 2/2007 |
| CN | 201216195 | Y | 4/2009 |
| CN | 101438862 | A | 5/2009 |
| CN | 201393579 | Y | 2/2010 |
| CN | 201640536 | U | 11/2010 |
| CN | 102726857 | A | 10/2012 |
| CN | 202714231 | U | 2/2013 |
| CN | 202980271 | U | 6/2013 |
| CN | 204070668 | U | 1/2015 |
| DE | 4244347 | A1 | 6/1994 |

* cited by examiner

HYBRID GLOVE

CROSS-REFERENCE TO RELATED APPLICATIONS

This application claims the priority and all the benefits of U.S. Provisional Application No. 62/571,424 filed on Oct. 12, 2017, the content of which is hereby incorporated by reference in its entirety.

TECHNICAL FIELD

The present principles generally relate to the field of gloves and, for example, gloves for consuming food.

BACKGROUND INFORMATION

The use of gloves when eating is well known in the art. The option to cover the hands and fingers while consuming a meal provides protection from oily foods, juicy sauces, sticky syrups, liquids, and all other food residue. The 5-digit, 3-digit, and 2-digit designs are typical styles used for various food purposes including during mealtime.

Numerous designs and selections have been made available to protect hands and fingers from contact with food. The conventional 5-digit glove made of vinyl, polyurethane, or rubber used in the food service industry protects the entire hands and fingers, however, with its one-size fits all, the fit is bulky and loose. The 3-digit glove design and 2-digit styles provide an alternative to the 5-digit but with less pockets, it still remains bulky and loose.

The bulkiness of these 5-digit, 3-digit, and 2-digit styles have not been sized to accommodate the wearer. They are also wrist length or longer and cover the whole hand without customization. These oversized devices present themselves as loose fitting apparel which appears cumbersome and as an inconvenient item to carry daily.

Existing gloves with the 3-digits do not appear to employ all-finger coverage, such as those shown in Publications CN201393579 (2010), DE4244347 A1 (1994), CN2562604 Y (2003), CN2865344Y (2007), CN201216195 Y (2009), CN2788592 Y (2006), CN101438862 A (2009), CN201640536U (2010), CN202714231U (2013), and U.S. Pat. No. 2,751,592 A (1956). These gloves also appear not to provide the ring and little fingers from protection from food residue which spreads onto the uncovered fingers. In addition, their length appears to be too short and therefore does not cover beyond the base of the fingers into the palm area.

The existing 2-digit gloves also appear to not cover all fingers, as shown in Publications CN202980271U (2013), CN102726857 (2012), and CN204070668 U (2015). The lack of coverage for the neighboring fingers does not protect all fingers from food residue since only two fingers have protection. Also these existing gloves also do not appear to cover beyond the base of the fingers into the palm area.

The 2-digit, 2-pocket or compartment mittens of publications U.S. Pat. No. 2,840,950 A (1958), and U.S. Pat. No. 5,987,645 A (1999) provide an individual pocket for the thumb with a second pocket for all fingers together in a shared pocket.

SUMMARY

All of these existing references do not have a hemline with a diagonal edge at the mid-palm level due to their shortness ending at the base of the fingers.

The short length of the existing gloves does not provide a partial coverage of the palm which in turn covers all fingers and thumb for protection from food residue. In contrast, the presented embodiments allow for a length beyond the base of the fingers into the palm area and beyond, with one of, e.g., a circular, square, rectangle, triangle, and inverted triangle shape to aid in dressing the glove into a hand of a wearer.

The presented device thus allows a more custom fit ending at the palm area instead of the wrist as the conventional glove length, and may have one or more of the following advantages:

(a) a shaped hemline which cannot be found in prior arts;

(b) the shaped hemline edges provide a functional tool (e.g., an extended tab) to aid in dressing the hand by pulling the device to insert the hand; and/or (c) size variations to suit the wearer.

The device has additional advantages in that:

(a) it permits the production of a variety of colors to be made for various occasions;

(b) it permits a name and logo to be printed on the extended section anywhere on either side of the device or have no print at all;

(c) it will allow the design's extended section to be kept intact as part of the design where it is unlike a machine part that can randomly break or be dislodged;

(d) it permits the material composition of a variety of lightweight vinyl, polyurethane, paper, felt, fabric, rubber or a mixture and combination of any of the above;

(e) it permits the shaped extended section of the hemline to exist on either side of the device top or bottom, or remain without a shape and straightedge;

(f) it will allow for size variations for children and adults, as well as custom and extra-large sizes to accommodate the wearer; and/or (g) it provides a flexible alternative with one less pocket to accommodate individuals who do not have all fingers on both hands or the occasions do not require the dexterity of the additional pocket.

The device relates to gloves and more particularly to a short palm length 3-pocket device in which the first pocket is for the thumb, a second pocket for the index and middle fingers, and a third pocket for the ring and little fingers while consuming finger foods to minimize contact with oily foods, juicy sauces, sticky syrups, liquids, and all other food residue.

The purpose of the presented device is to provide a disposable accessory when consuming finger foods whereby the dressing application is facilitated by a shaped diagonal hemline by which the shape can be pulled to dress the hand, and to provide a convenient device to carry when hand washing is not possible or inconvenient.

The target market may include all entities of the food industry, hotels, airlines, ships, trains, theaters, stadiums, and all arenas where finger foods are available.

DETAILED DESCRIPTION

3-Pocket/3-Digit Embodiments

Figure 1A:
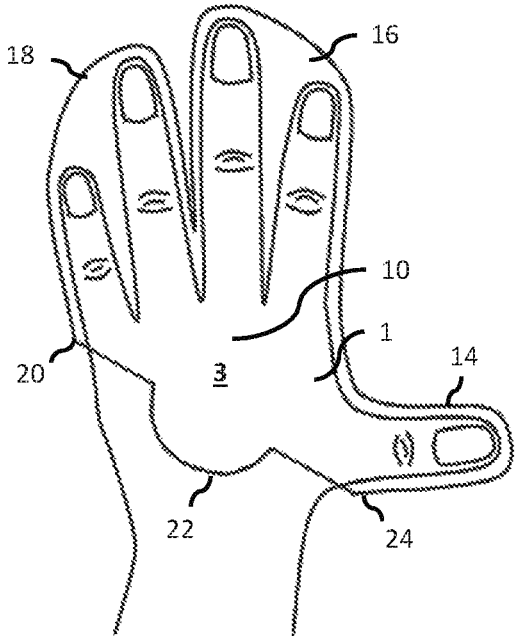
FIG. 1A and FIG. 1B are respectively pictorial representations of the left and right hand knuckle-side views of an example pair of 3-pocket/3-digit gloves with a circular shape or tab along the hemline.

Respective set of FIGS. 1A-1D, 2A-2D, 3A-3D, 4A-4D, 5A-5D and 6A-6D illustrates an exemplary pair of 3-pocket/3-digit finger food glove according to present embodiments and indicated by the reference numerals 3 for the left hand glove and 4 for the right hand glove. In the figures, each pair of the exemplary gloves 3 and 4 use the same numerals to illustrate the same portions of the gloves. The only difference between the different exemplary gloves is the bottom hemline 22 which may have an extension or a tab that may take on different shapes, sizes, lengths, widths, and etc. The finger food gloves are used to protect fingers of a pair of left hand 1 and right hand 2 from finger food residue and also when hand washing is not easily accessible with an enhanced feature of a shaped hemline 22 to aid with, e.g., putting the gloves on the hands.

Figure 1B:
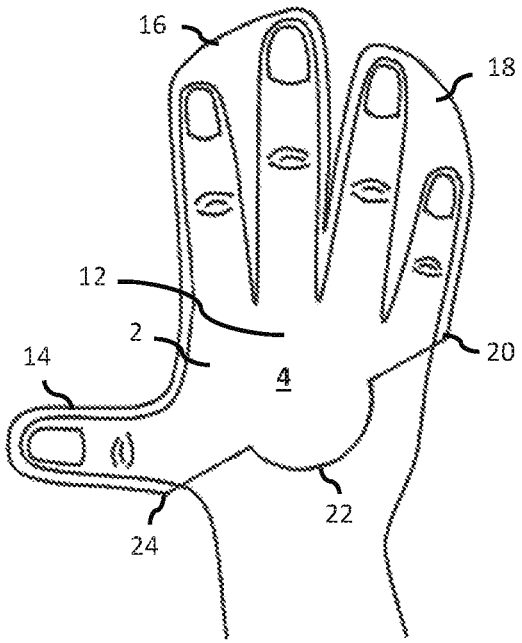
Figures 1C, 1D:
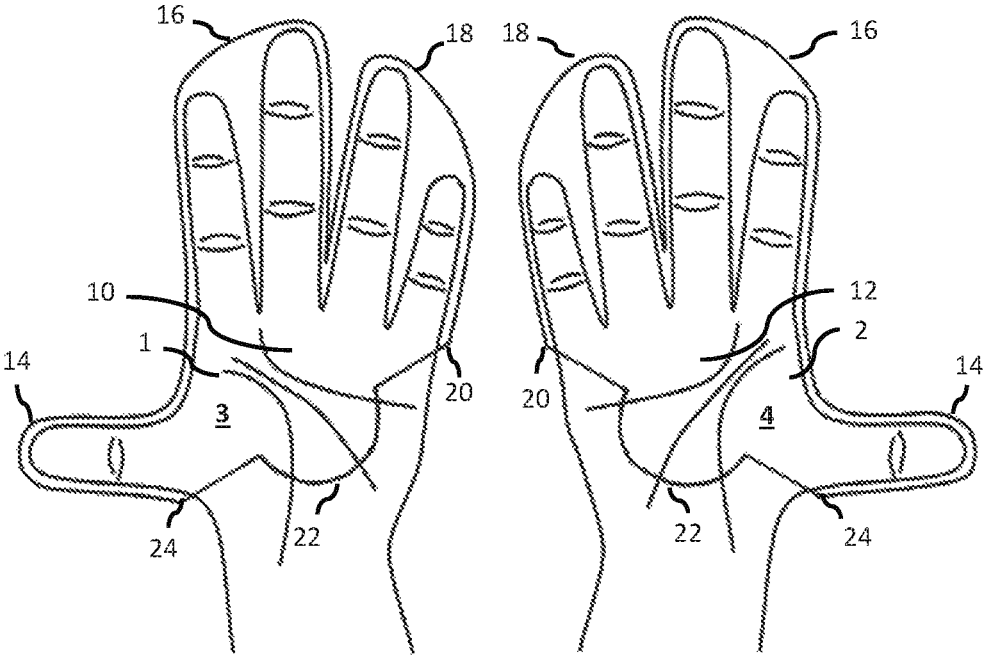
FIG. 1C and FIG. 1D are respectively pictorial representations of the left and right hand palm-side views of an example pair of 3-pocket/3-digit gloves with a circular shape or tab along the hemline.
Figure 2A:
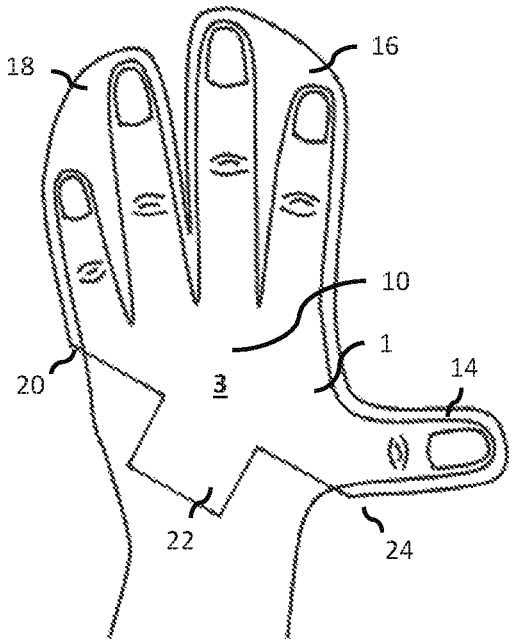
FIG. 2A and FIG. 2B are respectively pictorial representations of the left and right hand knuckle-side views of an example pair of 3-pocket/3-digit gloves with a square shape or tab along the hemline.
Figure 2B:
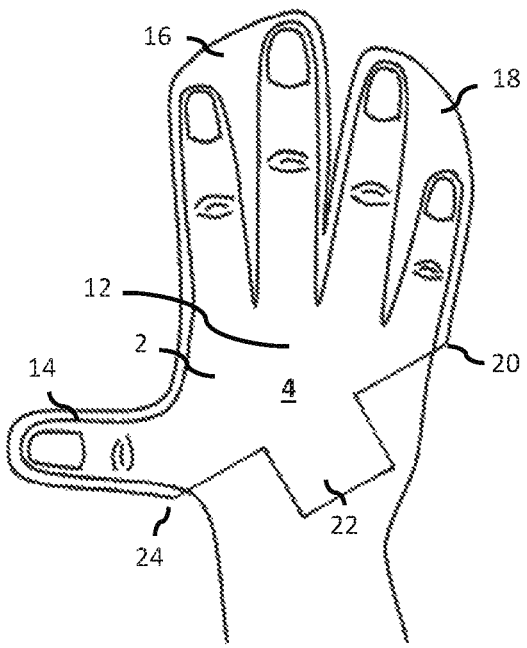
Figure 2C:
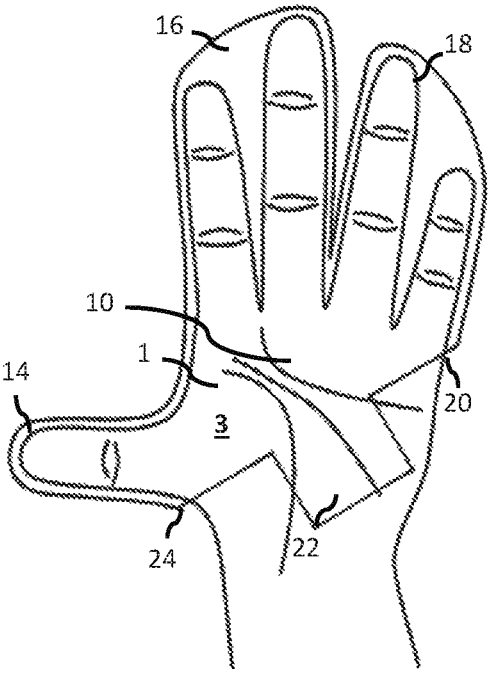
FIG. 2C and FIG. 2D are respectively pictorial representations of the left and right hand palm-side views of an example pair of 3-pocket/3-digit gloves with a square shape or tab along the hemline.
Figure 2D:
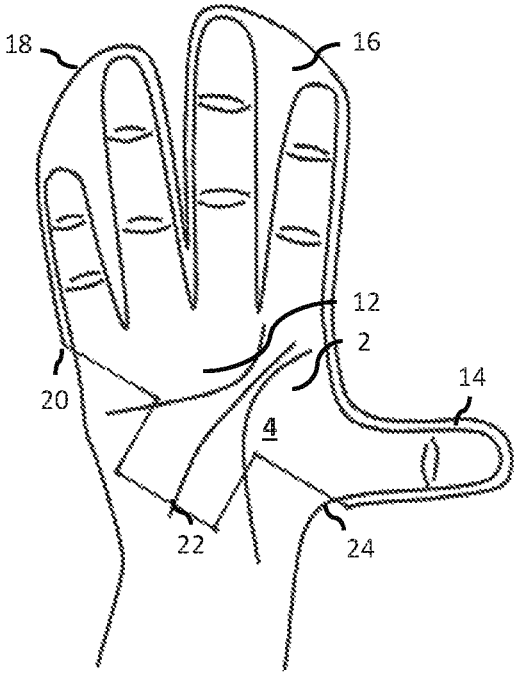
Figure 3A:
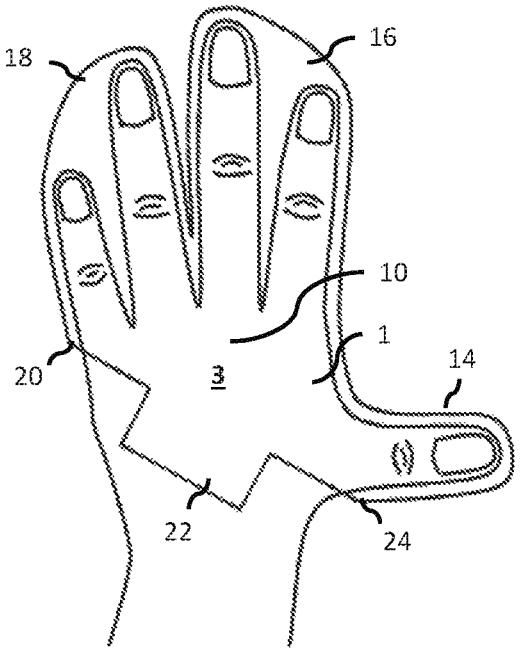
FIG. 3A and FIG. 3B are respectively pictorial representations of the left and right hand knuckle-side views of an example pair of 3-pocket/3-digit gloves with a rectangle shape or tab along the hemline.
Figure 3B:
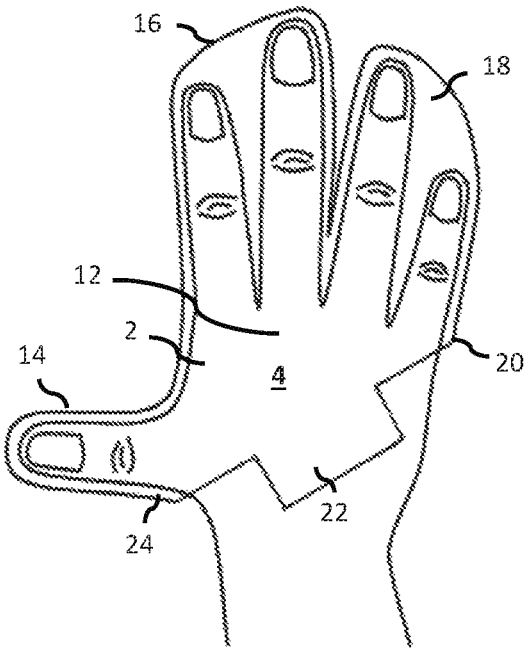
Figures 3C, 3D:
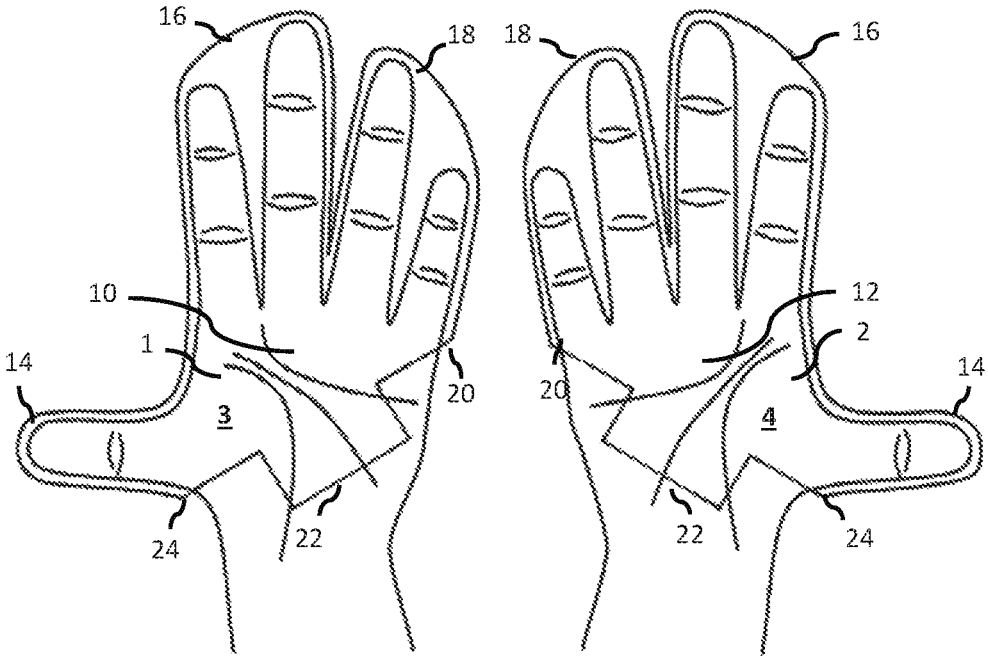
FIG. 3C and FIG. 3D are respectively pictorial representations of the left and right hand palm-side views of an example pair of 3-pocket/3-digit pocket gloves with a rectangle shape or tab along the hemline.
Figure 4A:
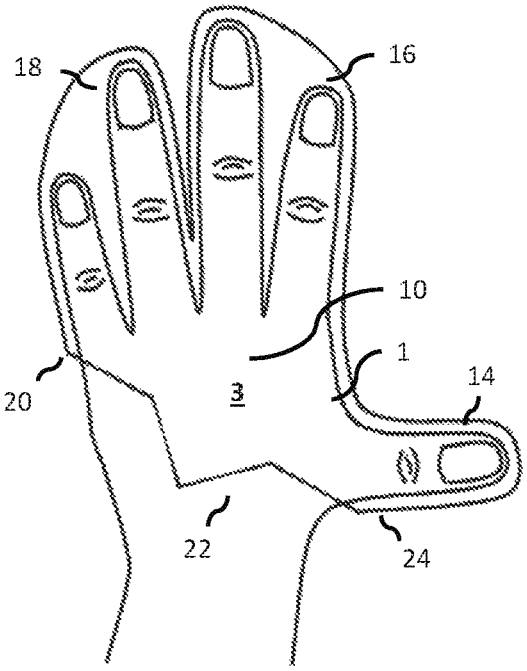
FIG. 4A and FIG. 4B are respectively pictorial representations of the left and right hand knuckle-side views of an example pair of 3-pocket/3-digit gloves with a triangle shape or tab along the hemline.
Figure 4B:
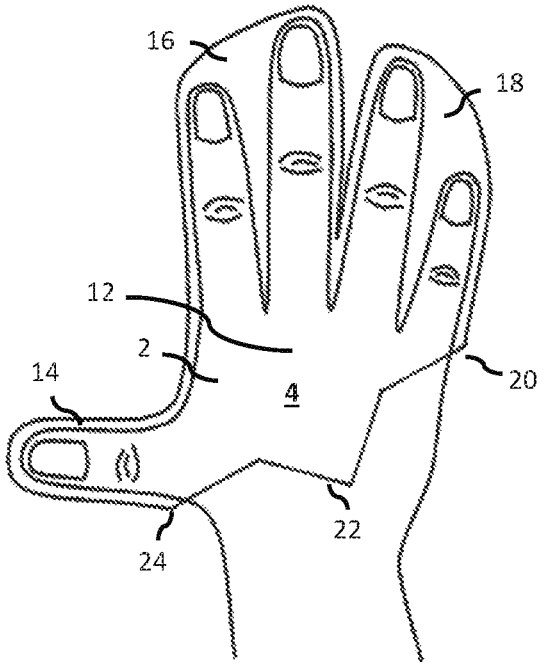
Figures 4C, 4D:
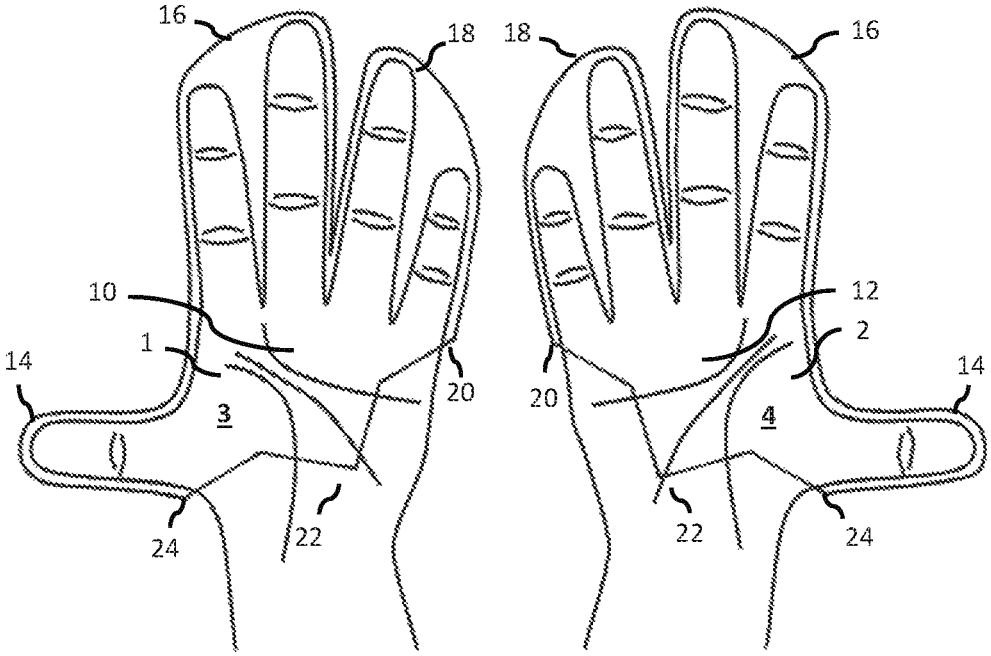
FIG. 4C and FIG. 4D are respectively pictorial representations of the left and right hand palm-side views of an example pair of 3-pocket/3-digit gloves with a triangle shape or tab along the hemline.
Figure 5A:
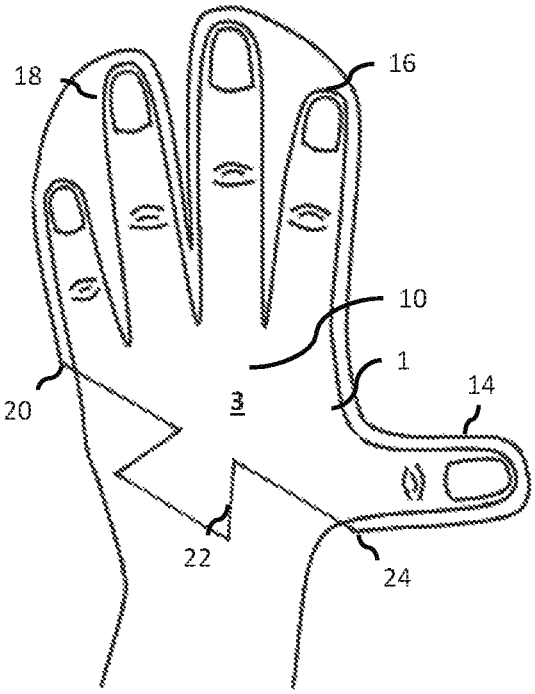
FIG. 5A and FIG. 5B are respectively pictorial representations of the left and right hand knuckle-side views of an example pair of 3-pocket/3-digit gloves with an inverted triangle shape or tab along the hemline.
Figure 5B:
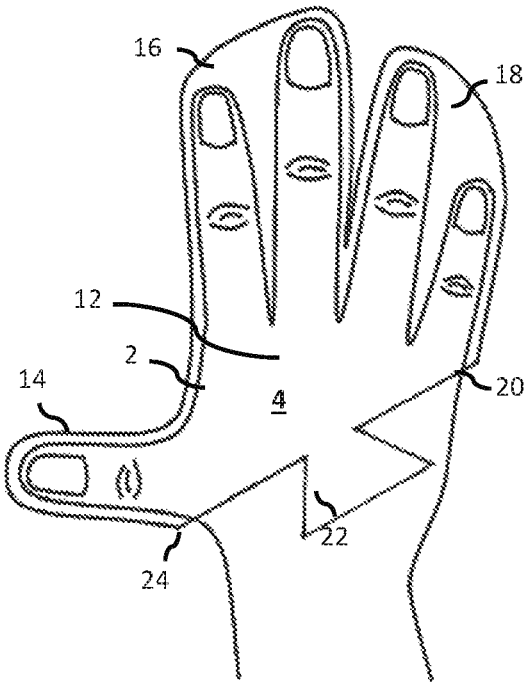
Figures 5C, 5D:
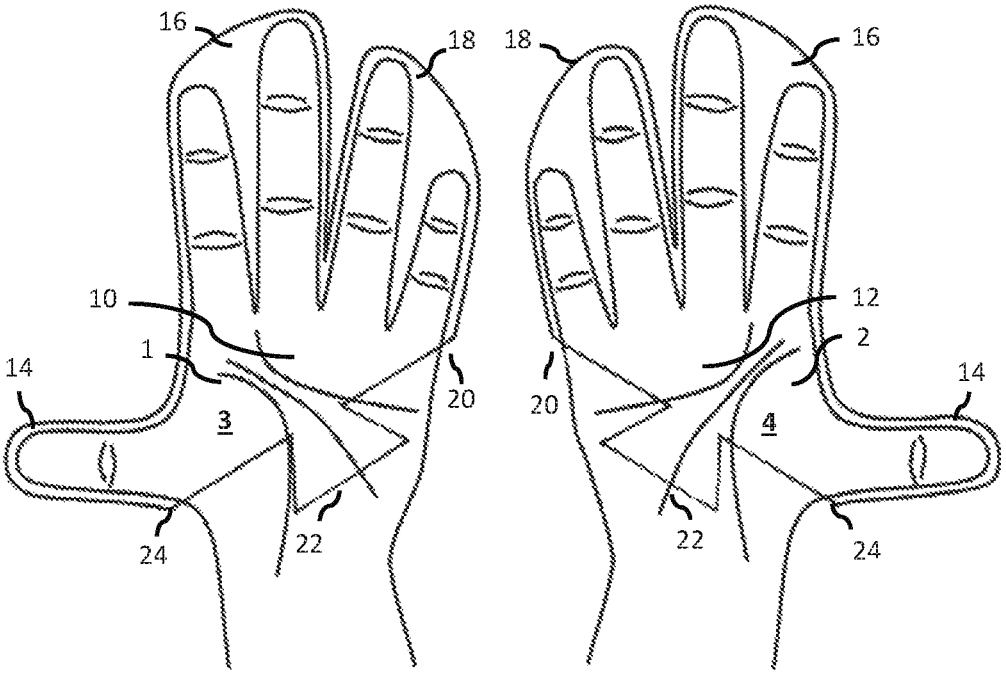
FIG. 5C and FIG. 5D are respectively pictorial representations of the left and right hand palm-side views of an example pair of 3-pocket/3-digit gloves with an inverted triangle shape or tab along the hemline.
Figure 6A:
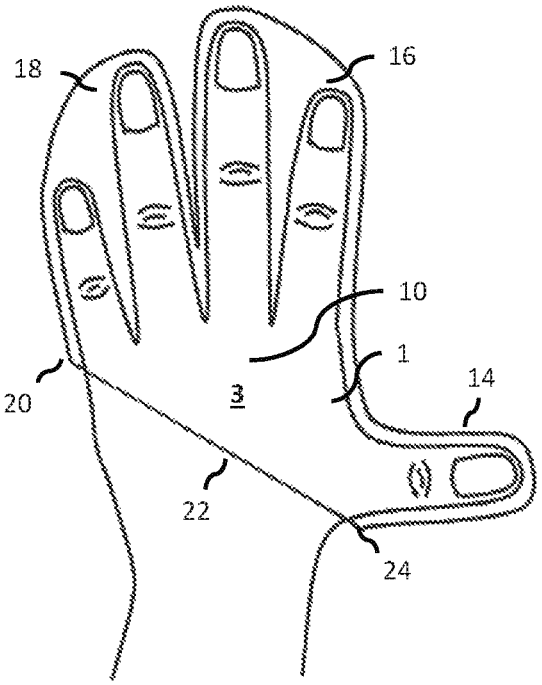
FIG. 6A and FIG. 6B are respectively pictorial representations of the left and right hand knuckle-side views of an example pair of 3-pocket/3-digit gloves with a straightedge along the hemline.
Figure 6B:
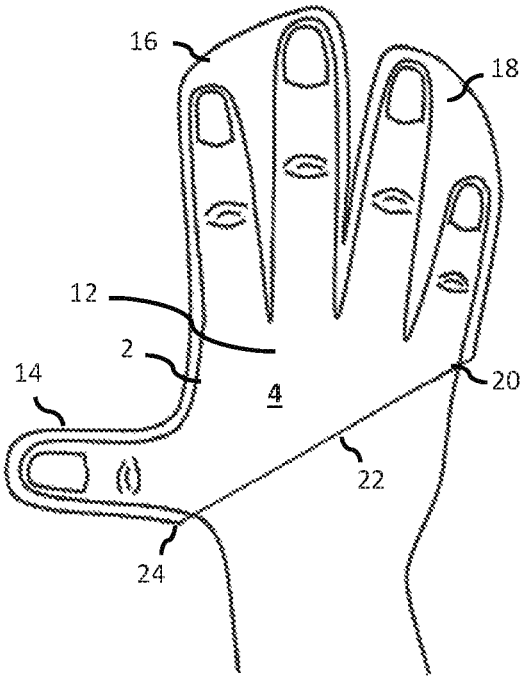
Figures 6C, 6D:
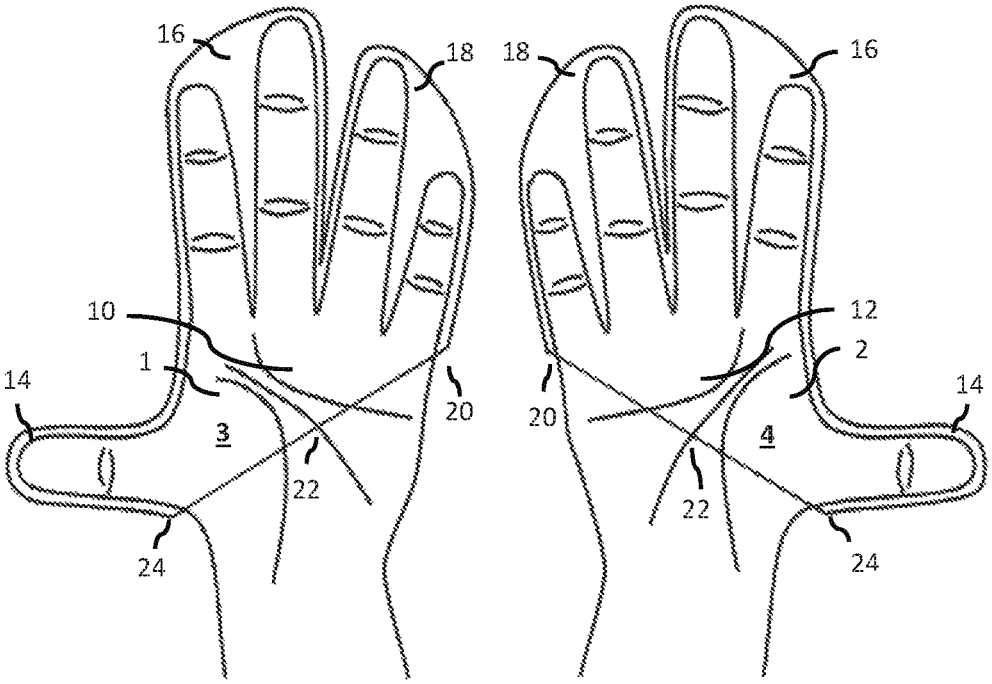
FIG. 6C and FIG. 6D are respectively pictorial representations of the left and right hand palm-side views of an example pair of 3-pocket/3-digit gloves with a straightedge along the hemline.

As illustrated in FIGS. 1A and 1B for the knuckle-side or back-side hand views, the pair of the food gloves 3 and 4 include a left and right hand surface portions 10 and 12 respectively to cover the hands over the back sides of the hands 1 and 2. Similarly, as shown in FIGS. 1C and 1D, the same portions of the food gloves also cover the palm sides of the hands as showing on the palm side views of the gloves.

The outline of the gloves circumvents the shape of the human hand with three pockets. For example, as shown in FIG. 1A, the left hand glove 3 has a first pocket 14 which receives the left hand thumb, a second pocket 16 receives the left index finger and left middle finger and a third pocket 18 receives the left ring finger and left little finger which ends at the base 20 of the third pocket 18 and crosses the hemline 22 and ends at the base 24 of the first pocket 14 which encloses the left thumb. Similarly, as shown in, e.g., FIG. 1B, the right hand glove 4 receives the right hand thumb in a first pocket 14. The second pocket 16 receives the right index finger and right middle finger. A third pocket 18 receives the right ring finger and right little finger which ends at the base 20 of the third pocket 18 and crosses the hemline 22 and ends at the base 24 of the first pocket 14 which encloses the right thumb.

The length of an exemplary glove extends from the apex of the second pocket 16 to the edge of the hemline 22 for both hands where the hand insertion point is between 20 and 24. In an aspect according to the present embodiments, the hemline 22 may be implemented with an extended shape or tab that may comprise various shapes, sizes, lengths or widths. As illustrated in FIGS. 1A-1D, the hemline 22 is implemented as having an extension shape or a tab of a half circular. As illustrated in FIGS. 2A-2D, the hemline or extension shape 22 is implemented as having an extension shape or a tab of a square. As illustrated in FIGS. 3A-3D, the hemline 22 is implemented as having an extension shape or a tab of a rectangle. As illustrated in FIGS. 4A-4D, the hemline 22 is implemented as having an extension shape or a tab of a triangle. As illustrated in FIGS. 5A-5D, the hemline 22 is implemented as having an extension shape or a tab of an inverted triangle. As illustrated in FIGS. 6A-6D, the hemline 22 is implemented as a straight edge without an extension or a tab. The various implementations of the hemline 22 may aid in dressing the hand with the gloves.

The exemplary pair of gloves as shown in 1A-1D, 2A-2D, 3A-3D, 4A-4D, 5A-5D and 6A-6D is constructed, for example, with thin clear vinyl, polyurethane, felt, paper, fabric, rubber or a combination of any of the above as a disposable device. They may be formed by cutting a piece of suitable material into 2 substantially symmetrical pieces for the left hand glove 3, and 2 pieces for the right hand glove 4 to construct a pair of gloves.

According to the present embodiments, one exemplary way to form a glove for either the right or the left hand is to place the left hand knuckle surface portion 10 shown in, e.g., FIG. 1A symmetrically with the right hand knuckle surface portion 12 shown in, e.g., FIG. 1B together with their interior surfaces facing each other. They are then fused from the base 24 of the first pocket 14 to the base 20 of the third pocket 18 along the top edge contour of the glove. That is, they are fused over the first pocket portion 14 then proceeding upward along the fingertips of the second pocket 16 then downward along the middle fingers then upward along the ring and little fingers over the third pocket 18, continuing downward to the base 20 of the third pocket 18 with an unfused area between 20 to 24, along the hemline 22 for insertion of a hand 1 or 2.

Similarly, the right hand surface portion 12 shown in FIG. 1B may be symmetrically placed with the surface portion 10 together with interior surfaces facing each other and fused from the base 24 of the first pocket 14 over the thumb proceeding upward along the fingertips of the second pocket 16 then downward along the middle fingers then upward along the ring and little fingers over the third pocket 18 continuing downward to the base 20 of the third pocket 18, with an unfused area between 20 to 24, along the hemline 22 for insertion of a hand 1 or 2.

The fusing will depend on the material being used and may include applying heat, glue, sewing, and etc., as well known by a person of ordinary skill in the art.

The manner of using this device is similar to that of its present dressing movement by inserting the fingers into the opening of the device and placing the fingers into their respectively assigned pockets. As noted already, one aspect of the improvements over the prior art is that the prior art gloves have no extension at the hemline to aid in pulling the device on where as the present embodiments provide a mechanism to assist with dressing.

2-Pocket/2-Digit Embodiments

Another embodiment is an alternative 2-pocket/2-digit device for individuals who do not possess all the fingers and/or for the occasions that may not require the dexterity which the 3-pocket/3-digit device has been designed for. The design and construction remain the same as the 3-pocket/3-digit embodiments with the elimination of one pocket.

The exemplary 2-pocket/2-digit embodiments which provide one less pocket are shown in FIGS. 7A-7D, 8A-8D, 9A-9D, 10A-10D, 11A-11D and 12A-12D respectively. They provide an added comfort option according to the principals of the present invention and are illustrated by the above drawings with corresponding reference numerals as to be described. Similarly, the exemplary gloves are used to protect fingers from finger food residue and also when hand washing is not accessible or convenient with an enhanced feature of a shaped hemline to aid with dressing the hand to the glove. The only difference between the different exemplary gloves shown in the sets of FIGS. 7A-7D, 8A-8D, 9A-9D, 10A-10D, 11A-11D and 12A-12D is the bottom hemline 40 which may have different extensions or tabs which may take on different shapes, sizes, lengths, widths, and etc. In each set of the figures, each pair of the exemplary gloves 5 and 6 use the same numerals to illustrate the same portions of the gloves.

Figure 7A:
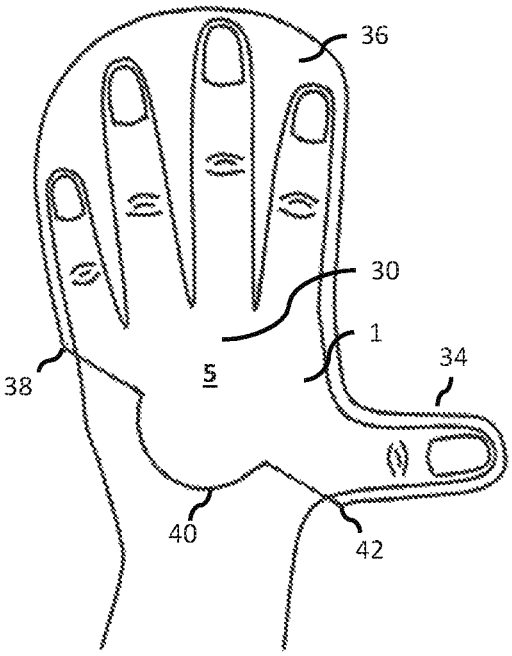
FIG. 7A and FIG. 7B are respectively pictorial representations of the left and right hand knuckle-side views of an example pair of 2-pocket/2-digit gloves with a circular shape or tab along the hemline.
Figure 7B:
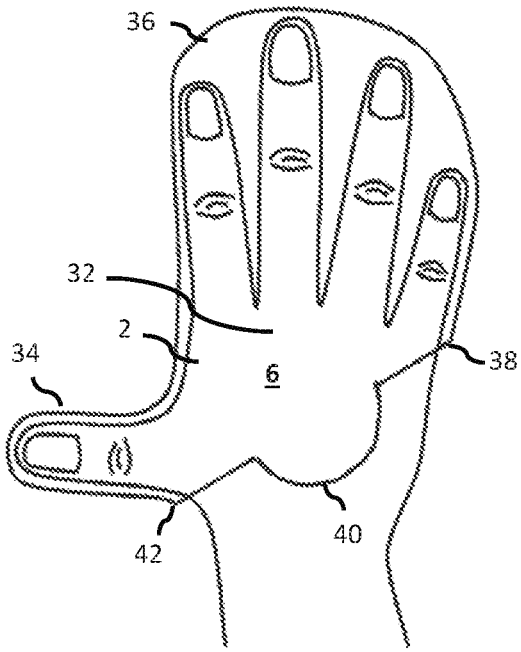
Figures 7C, 7D:
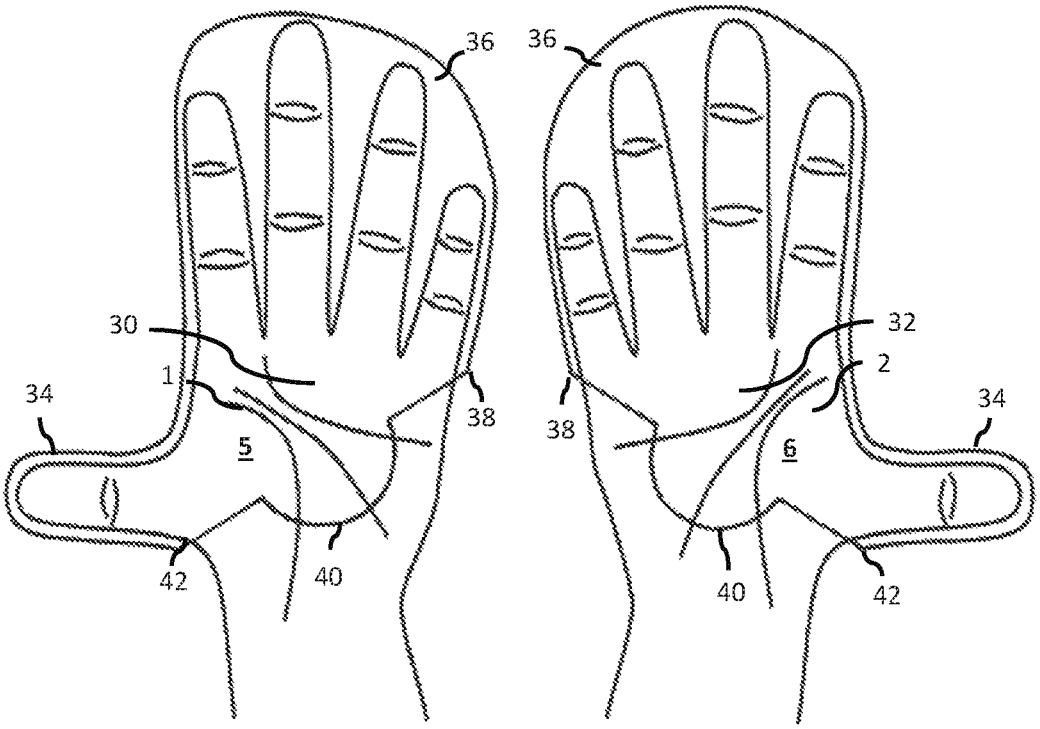
FIG. 7C and FIG. 7D are respectively pictorial representations of the left and right hand palm-side views of an example pair of 2-pocket/2-digit gloves with a circular shape or tab along the hemline.
Figure 8A:
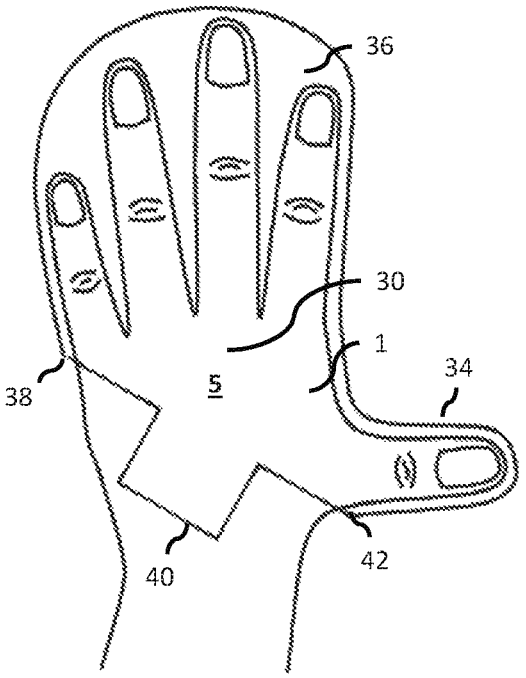
FIG. 8A and FIG. 8B are respectively pictorial representations of the left and right hand knuckle-side views of an example pair of 2-pocket/2-digit gloves with a square shape or tab along the hemline.
Figure 8B:
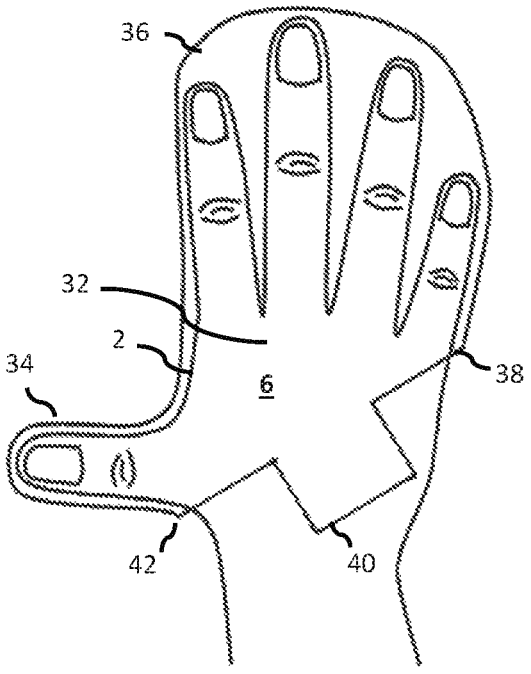
Figures 8C, 8D:
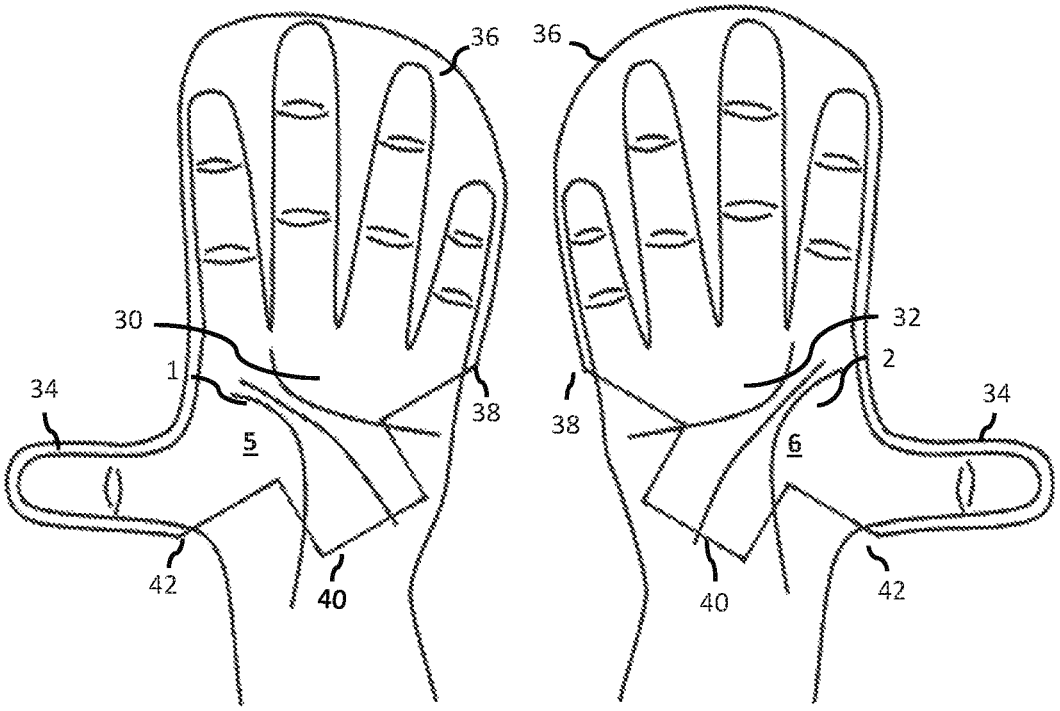
FIG. 8C and FIG. 8D are respectively pictorial representations of the left and right hand palm-side views of an example pair of 2-pocket/2-digit gloves with a square shape or tab along the hemline.
Figure 9A:
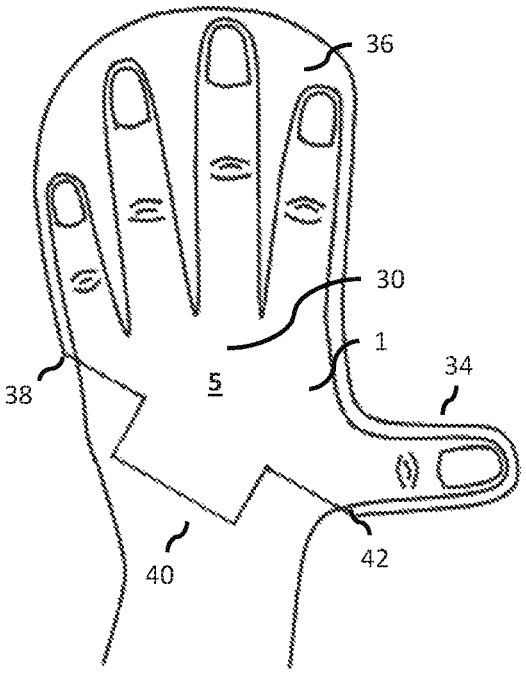
FIG. 9A and FIG. 9B are respectively pictorial representations of the left and right hand knuckle-side views of an example pair of 2-pocket/2-digit gloves with a rectangle shape or tab along the hemline.
Figure 9B:
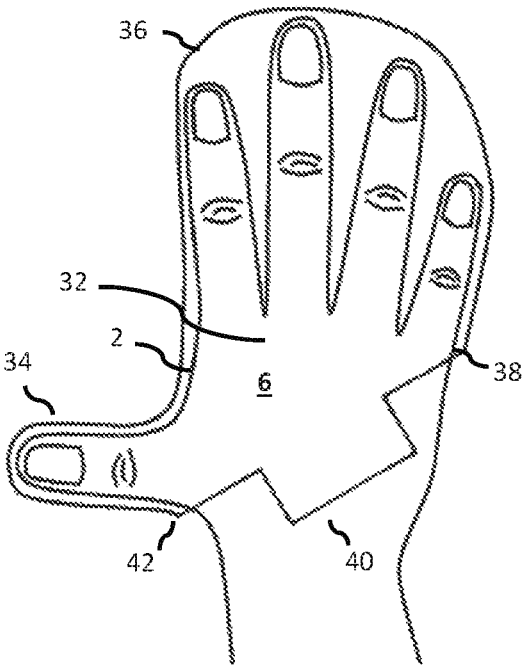
Figure 9C:
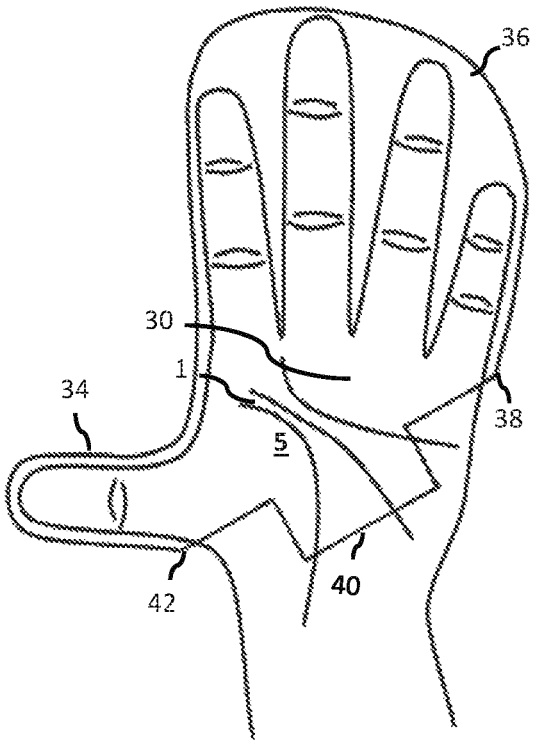
FIG. 9C and FIG. 9D are respectively pictorial representations of the left and right hand palm-side views of an example pair of 2-pocket/2-digit gloves with a rectangle shape or tab along the hemline.
Figure 9D:
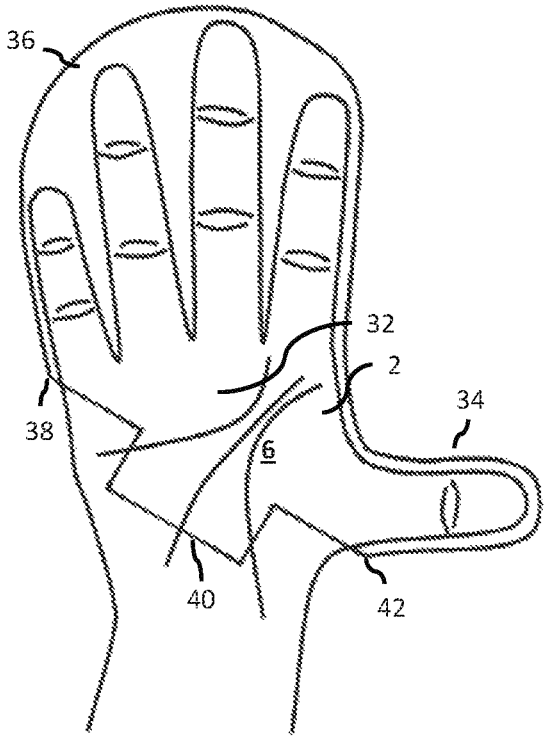
Figure 10A:
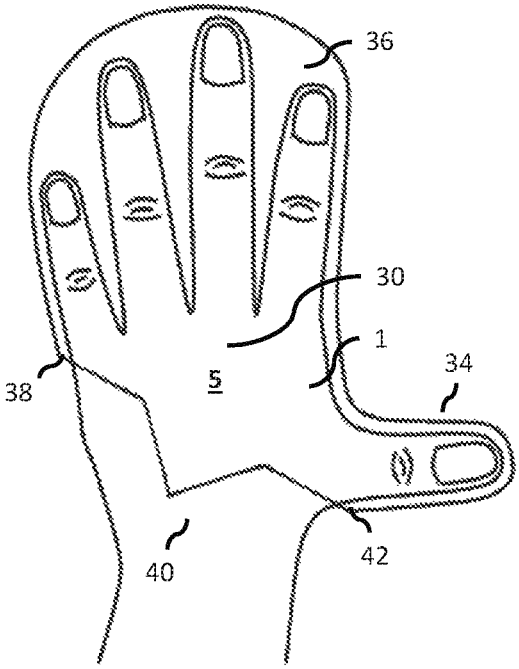
FIG. 10A and FIG. 10B are respectively pictorial representations of the left and right hand knuckle-side views of an example pair of 2-pocket/2-digit gloves with a triangle shape or tab along the hemline.
Figure 10B:
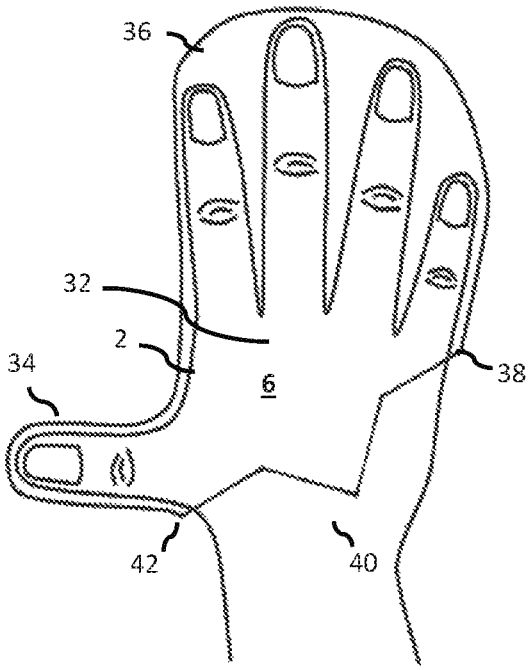
Figures 10C, 10D:
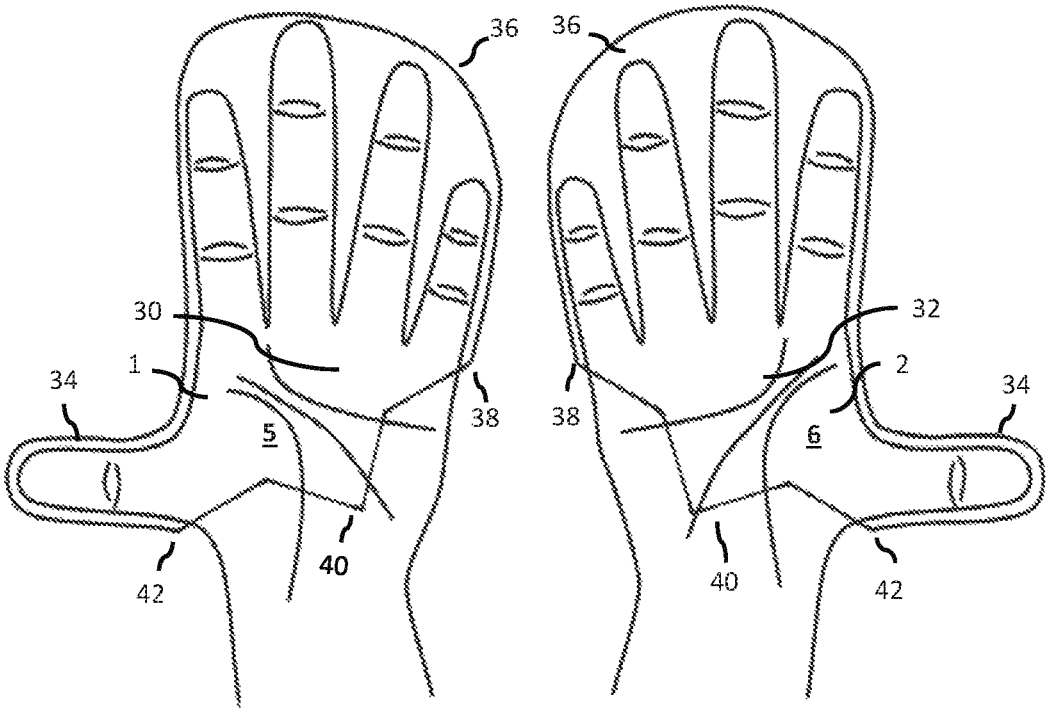
FIG. 10C and FIG. 10D are respectively pictorial representations of the left and right hand palm-side views of an example pair of 2-pocket/2-digit gloves with a triangle shape or tab along the hemline.
Figure 11A:
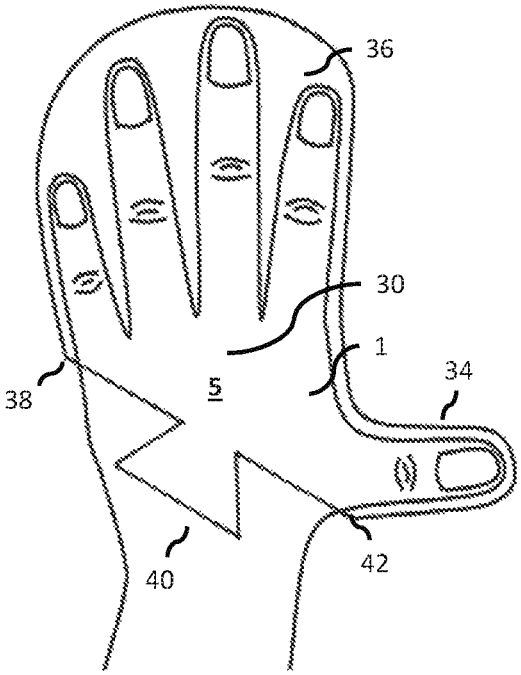
FIG. 11A and FIG. 11B are respectively pictorial representations of the left and right hand knuckle-side views of an example pair of 2-pocket/2-digit gloves with an inverted triangle shape or tab along the hemline.
Figure 11B:
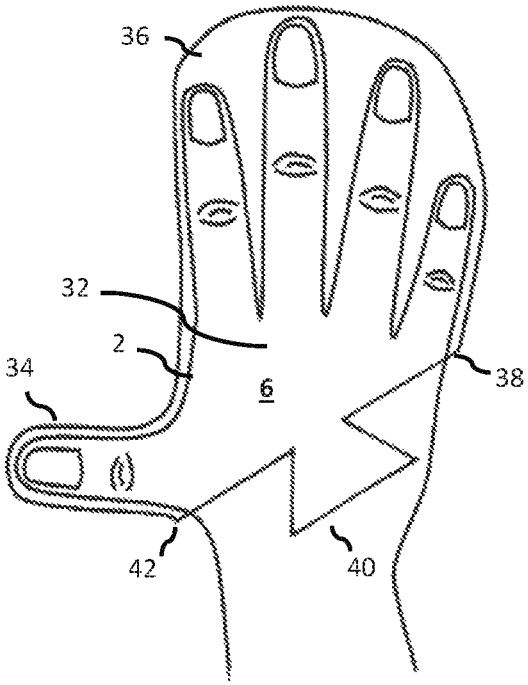
Figure 11C:
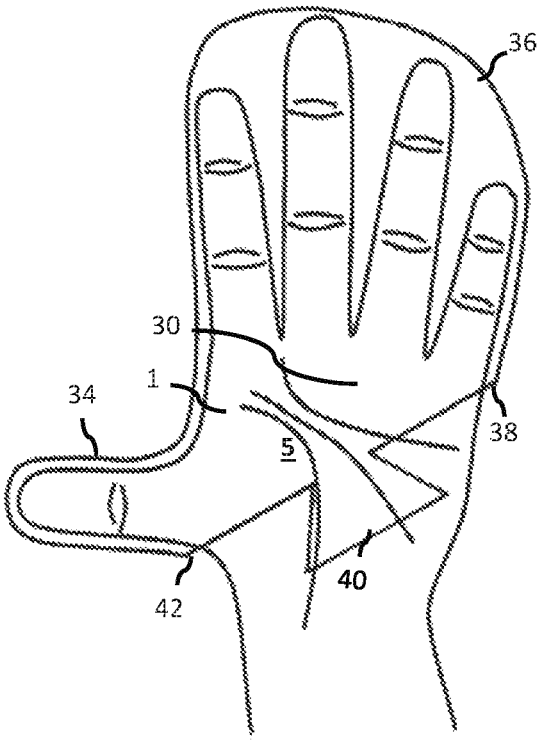
FIG. 11C and FIG. 11D are respectively pictorial representations of the left and right hand palm-side views of an example pair of 2-pocket/2-digit gloves with an inverted triangle shape or tab along the hemline.
Figure 11D:
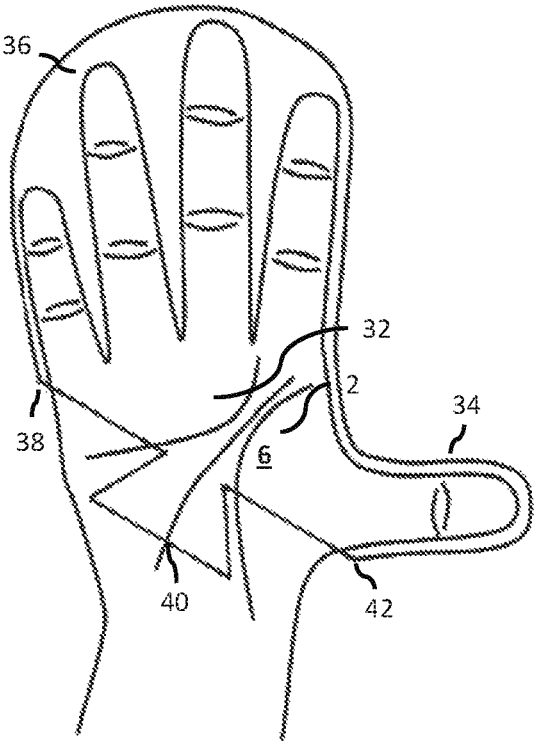
Figure 12A:
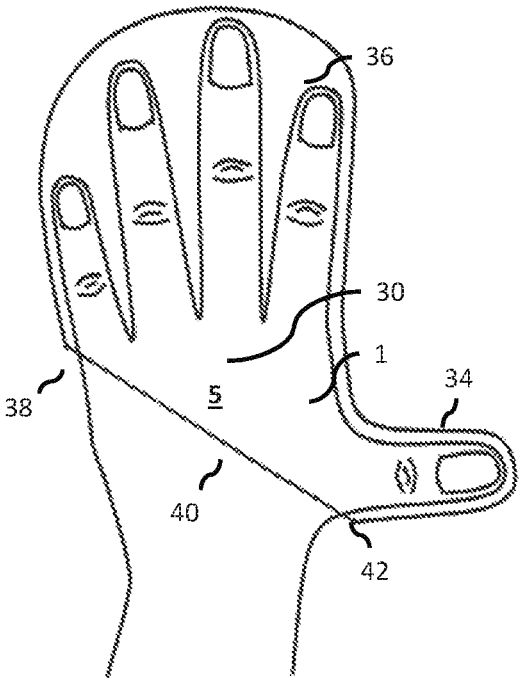
FIG. 12A and FIG. 12B are respectively pictorial representations of the left and right hand knuckle-side views of an example pair of 2-pocket/2-digit gloves with a straightedge along the hemline.
Figure 12B:
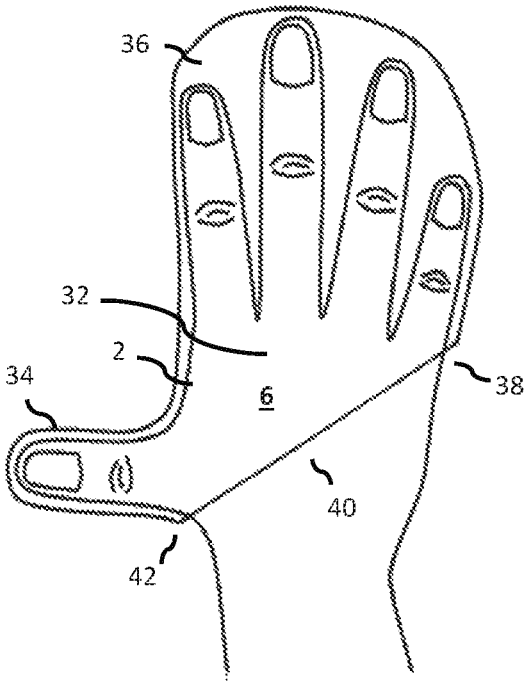
Figures 12C, 12D:
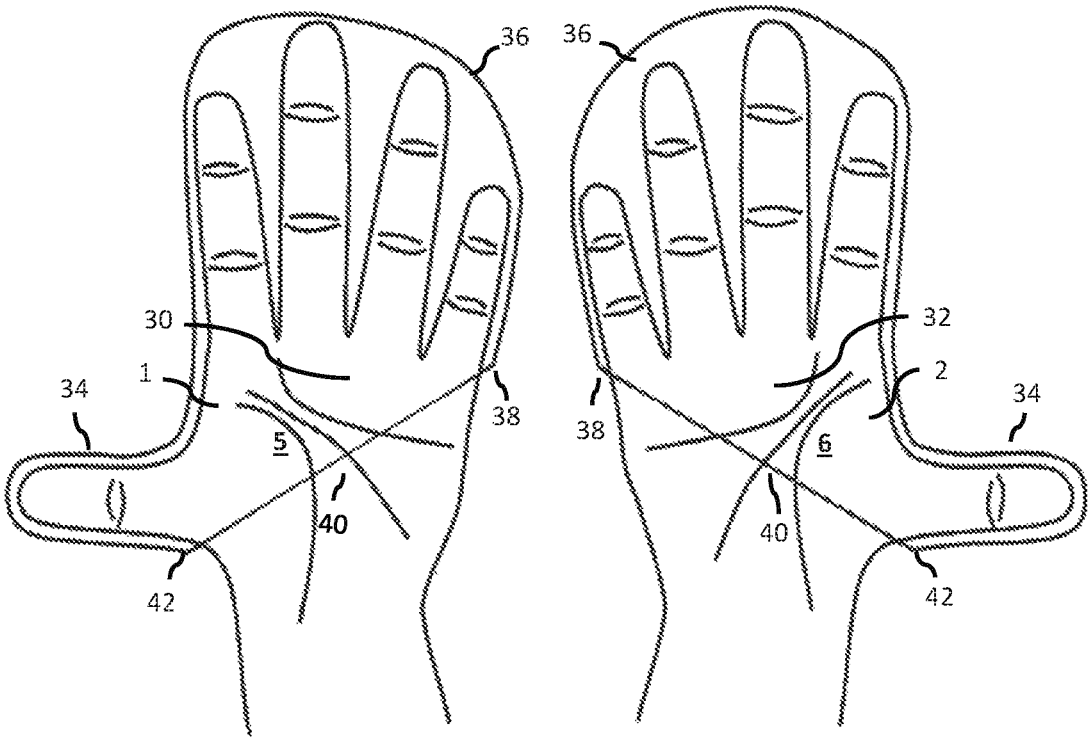
FIG. 12C and FIG. 12D are respectively pictorial representations of the left and right hand palm-side views of an example pair of 2-pocket/2-digit gloves with a straightedge along the hemline.

As illustrated in, e.g., FIGS. 7A-7B, the left and right food gloves 5 and 6 include a left and right hand knuckle surface portions 30 and 32 to cover each of the hands 1 and 2 over the knuckle sides. Likewise, FIGS. 7C-7D illustrates a palm surface portions 30 and 32 covering the palm sides of the hands 1 and 2.

As shown in, e.g., FIG. 7A, for a left hand 1, the outline of the glove provides two pockets where the left hand glove 5 has a first pocket 34 which receives the left hand thumb. A second pocket 36 which receives the left index finger, left middle finger, left ring finger, and left little finger that ends at the base 38 of the second pocket 36, and crosses the hemline 40 and ends at the base 42 of the pocket 34 enclosing the left thumb of left hand 1.

Likewise, as shown in, e.g., FIG. 7B, for a right hand 2, the right hand glove 6 receives the right hand thumb in a first pocket 34. A second pocket 36 receives the right index finger, right middle finger, right ring finger, and right little finger that ends at the base 38 of the second pocket 36 and crosses the hemline 40 and ends at the base 42 of the first pocket 34 enclosing the right thumb of the right hand 2.

The length of the gloves extends from the apex of the second pocket 36 to the edge of the extension shape 40 for both hands where the hand insertion point is between 38 and 42 with various shapes of, e.g., a half circular, square, rectangle, triangle, and inverted triangle to aid in dressing the hand, with an option of a shapeless or straight edge as shown respectively in FIGS. 7A-7D, 8A-8D, 9A-9D, 10A-10D, 11A-11D and 12A-12D.

The exemplary 2-digit, 2-compartment or 2-pocket pair of gloves may be constructed with a thin clear vinyl, polyurethane, felt, paper, fabric, rubber or a combination of any of the above as a disposable device and cut into 2 pieces for the left side hand and 2 pieces for the right side hand in order to construct a pair of gloves.

For example, for a left hand glove 5 as shown in, e.g., FIG. 7A, the left hand knuckle surface portion 30 shown is symmetrically placed with the palm surface portion 30 shown in FIG. 7C, together with interior surfaces facing each other and fused from the base 42 of the first pocket 34 enclosing the thumb, proceeding upward along the second pocket 36, continuing downward to the base 38 of the second pocket 36, with an unfused area between points 38 and 42 for inserting a hand.

Similarly, for a right hand glove 6 as shown in, e.g., FIG. 7B, the right hand knuckle surface portion 32 is symmetrically placed with the palm surface portion 32 shown in FIG. 7D, together with interior surfaces facing each other, and fused from the base 42 of the first pocket 34 proceeding upward along the second pocket 36 continuing downward to the base 38 of the second pocket 36 with an unfused area between 38 to 42 to insert the right hand.

The fusing will depend on the material being used and may include applying heat, glue, sewing, etc., as well known by a person of ordinary skill in the art.

Although the description above contains many specificities, these should not be used to limit the scope of the present exemplary embodiments. The general scope of its use and functional ability may be adjusted to suit the device to possess all the comfort and purpose for which it is designed. It is understood that the dimensions of the device will include size variations, materials, shapes, colors, function assembly, and the intended use is readily apparent and noticeable to one skilled in the art, and are described as depicted in the illustrations which refers to the device. For example, minor changes may be expected to provide those individuals with missing fingers a device suitable to their needs, and/or suitable for different applications.

In one aspect of the present principles, the diagonal hemline shapes of the present exemplary glove provide an improved mechanism to aid in dressing the hand. The diagonal hemline provides an edge to pinch and pull the glove. The exemplary shapes may be, e.g., a half-circle and similar circular forms of curved shapes, square and similar square forms of squared shapes, rectangle and similar rectangle forms of rectangle shapes, triangle and similar triangle forms of triangle shapes, inverted triangle and similar inverted triangle forms of inverted triangle shapes, or the like and may take the form of something other than that of what has been stated within the confines of the hemline.

In another exemplary aspect, the exemplary glove hemline may serve as a shape shifter line wherein the shapes are interchangeable such as a circular top with a square bottom as well as shapeless whereby the hemline remains without a shape and diagonally straightedge. In yet another exemplary aspect, the exemplary glove hemline may appear on the palm side of the hand with a shape and knuckle side of the hand as diagonally straightedge. In another aspect, the glove hemline may appear on the knuckle side of the hand with a shape and palm side of the hand as diagonally straightedge.

In yet another exemplary aspect, the exemplary glove hemline may have a length which extends beyond the base of the fingers, contrary to the prior art devices. In another exemplary aspect, a method is provided to pinch and pull the shaped hemlines to aid in dressing the exemplary glove to a hand of a wearer of the glove.

In yet another exemplary aspect, the exemplary glove hemline may be shapeless if no shape is desired.

In yet another exemplary aspect the exemplary glove may have a 2-digit compartment as an alternative to individuals who do not possess all the fingers or need the added dexterity which the 3-digit compartment device has been designed to better suit the individual. The design and construction remain the same with the elimination of one compartment or pocket.

In yet another exemplary aspect, the body material of an exemplary glove may be constructed with a lightweight flexible vinyl with optional flexible lightweight materials of polyurethane, paper, felt, fabric, rubber, and a combination of one or more of the above materials.

In yet another exemplary aspect, an outer perimeter of an exemplary glove may be joined with the knuckle side and palm side pieces to create a right hand glove. In another example, the outer perimeter of an exemplary glove may be joined with the knuckle side and palm side pieces to create a left side glove.

In yet another exemplary aspect, an exemplary pair of gloves may be clear in appearance and additionally may provide a variety of colors and print designs to fulfill the need for requested occasions. The exemplary gloves may allow printed words and company logos to be imprinted on the shapely hemlines with permission from interested parties. The exemplary gloves may allow printed words and company logos to be imprinted on the straightedge hemlines with permission from interested parties.

In yet another exemplary aspect, the exemplary pair of gloves may have on the knuckle side a different color from the palm side.

In yet another exemplary aspect, a pair of gloves may be used while eating foods, in particular finger foods.

The constant consumption of finger foods and hygiene addresses the need for a device to protect all fingers from food residue. This small and lightweight device can be an item to carry in a shirt or pants pocket, wallet, eyeglass case, handbag, backpack or other carry-on device and can even be attached to a water bottle. The minimal space it requires facilitates the inconvenient moments when hand washing is not accessible.

The device can be used whenever finger foods are consumed such as with sushi, pizza, French fries, tacos, burritos, burgers, sandwiches, fried chicken, popcorn, pastries, and any other type of food which does not require utensils and can also be employed as a hygienic apparatus.

The arena which this device will market to is within restaurants, fast food establishments, hotels, airlines, cruise ships, trains, theaters, stadiums, offices, vehicle drivers as well as birthday parties, showers, weddings, funerals and the like. The field it will market toward is open as long as finger foods are available and we all keep eating it.

The various shapes, materials, colors and sizes can cater to the occasion of its wearer and it will also provide a 2-digit alternative model for individuals who do not have all fingers by which the pockets can be filled. Additionally, the device will allow for printing logos and company names when requested.

Since the prior arts do not provide a thin short finger food glove with a shaped diagonal hemline to aid in dressing the hand for finger food eaters when hand washing is not accessible, the unfulfilled need is now resolved by a useful, novel, and nonobvious device.

What is claimed is:

1. A glove comprising:

a palm surface for covering a palm side of a hand of a wearer;

a knuckle surface for covering a knuckle side of the hand of the wearer;

a thumb pocket;

an index-finger and middle-finger pocket;

a ring-finger and little finger pocket;

a diagonal hemline on bottom of the glove, wherein the diagonal hemline is adapted to be situated at a mid-palm level of the hand of the wearer and has a downward slope extending from a position at a base of the ring-finger and little finger pocket to a position at a base of the thumb pocket; and an extended tab extending from the diagonal hemline.

2. The glove of claim 1 wherein the tab is in a half-circle shape.

3. The glove of claim 1 wherein the tab is in a square shape.

4. The glove of claim 1 wherein the tab is in a rectangle shape.

5. The glove of claim 1 wherein the tab is in a triangle shape.

6. The glove of claim 1 wherein the tab is in an inverted triangle shape.

7. The glove of claim 1, wherein the palm surface has a diagonal hemline shape different than that of the knuckle surface.

8. The glove of claim 1 wherein the diagonal hemline with the tab is on the palm surface of the glove.

9. The glove of claim 1 wherein the diagonal hemline with the tab is on the knuckle surface of the glove.

10. The glove of claim 1 wherein the glove is comprised of one or more of following materials: vinyl, polyurethane, paper, felt, fabric, and rubber.

11. The glove of claim 1 wherein a perimeter of the knuckle surface and a perimeter of the palm surface are joined to create a right hand glove or a left hand glove.

12. The glove of claim 1 wherein the tab is on each of the palm surface and the knuckle surface.

13. The glove of claim 1 wherein the glove comprises words or a company logo imprinted on the diagonal hemline.

14. The glove of claim 1 wherein the glove is adapted to be used for eating food and the tab is adapted to aid in dressing the glove to a hand.

15. The glove of claim 1 wherein the diagonal hemline has a length adapted to extend beyond a base of a wearer's fingers.

16. The gloves of claim 11 wherein the knuckle surface is in a different color than the palm surface.

* * * * *